US005881398A

United States Patent [19]

Franzen

[11] Patent Number: 5,881,398

[45] Date of Patent: Mar. 16, 1999

[54] WASHBASIN VALVE WITH INTEGRATED WATER TRAP

[75] Inventor: Hans Franzen, Nyköping, Sweden

[73] Assignees: Hans Franzen, Nykoping; System Teeg AB, Marsta, both of Sweden

[21] Appl. No.: 817,512

[22] PCT Filed: Oct. 16, 1995

[86] PCT No.: PCT/SE95/01199

§ 371 Date: Apr. 17, 1997

§ 102(e) Date: Apr. 17, 1997

[87] PCT Pub. No.: WO96/12071

PCT Pub. Date: Apr. 25, 1996

[30] Foreign Application Priority Data

Oct. 17, 1994 [SE] Sweden ..... 9403540

[51] Int. Cl.[6] ..... E03C 1/28

[52] U.S. Cl. ..... 4/295; 4/679

[58] Field of Search ..... 4/286–288, 293, 4/295, 679, 695, 681, 682, 688

[56] References Cited

U.S. PATENT DOCUMENTS

| | | | |
|---|---|---|---|
| 1,469,790 | 10/1923 | Hysko | 4/286 |
| 2,095,241 | 10/1937 | Cox | 4/295 |
| 3,725,964 | 4/1973 | Whitsett | 4/197 |
| 3,751,734 | 8/1973 | Lumadue | 4/679 |
| 4,254,512 | 3/1981 | Soderstrom | 4/679 |
| 4,463,461 | 8/1984 | Van Den Broeke et al. | 4/288 |
| 4,586,203 | 5/1986 | Westgerdes | 4/287 |

FOREIGN PATENT DOCUMENTS

| | | | |
|---|---|---|---|
| 138796 A1 | 4/1985 | European Pat. Off. | 4/679 |
| 65.148 | 1/1956 | France . | |
| 1658202 A | 10/1970 | Germany | 4/679 |
| 2150158 A | 4/1973 | Germany | 4/679 |
| 21 50 158 | 7/1995 | Germany . | |
| 3-115627 | 5/1991 | Japan | 4/679 |
| 615087 A | 12/1948 | United Kingdom | 4/287 |
| 1079680 A | 8/1967 | United Kingdom | 4/679 |
| 2216558 A | 10/1989 | United Kingdom | 4/679 |

*Primary Examiner*—Charles R. Eloshway
*Attorney, Agent, or Firm*—Banner & Witcoff, Ltd.

[57] ABSTRACT

To simplify fitting, securing and cleaning of a water trap to/from a washbasin or sink, there is provided a washbasin valve which has a water trap integral therewith and which forms a unit that can be inserted into and secured to the bottom of a washbasin, therewith a water drainage system can be connected directly to the valve. The washbasin valve is fitted by pushing the valve into a hole in the bottom of the basin and securing the valve therein, whereafter the valve is connected directly to a drain pipe. In cleaning the water trap, the seal is drawn-up out of the valve with the water drainage system still connected. No water will be spilled unnecessarily onto the floor beneath the washbasin in so doing.

3 Claims, 3 Drawing Sheets

WASHBASIN VALVE WITH INTEGRATED WATER TRAP

TECHNICAL FIELD

The present invention relates to a valve means which incorporates a water trap, preferably valve means for washbasins or sinks which prevent the entry of gases to the washbasin or sink from a waste-water drainage system connected thereto.

BACKGROUND ART

Water traps are provided at all points where waste-water drainage systems are connected to washbasins, sinks, floor drains and the like, to prevent the spreading of bad air. The water trap is a so-called communicating vessel having two separated liquid surfaces which permit the passage of liquid while excluding air, wherein the two liquid surfaces may be subjected to different air pressures from different air systems.

Water traps are normally fitted beneath washbasins and sink units in direct connection therewith. Because of their often impractical positions, it is difficult to clean such water traps without dirtying surrounding areas.

Floor drains often have a built-in water trap, which thus forms part of a construction. It is therefore often difficult to clean floor drains and water traps that are used in conjunction with shower cabinets and bathtubs, both of which must be connected to a floor drainage system. U.S. Pat. No. 3,725,964 teaches a liftable plumbing trap for connection to water outlets, for instance.

Lifting of the plumbing trap taught by U.S. Pat. No. 3,725,964, however, requires that the trap must be unscrewed from its mounting in order to be lifted. Unscrewing of the trap is effected with the aid of a strainer connected to a closure plug. The screwing action is transmitted through an arrangement of openings and hooks.

FR 65 148 teaches a water trap construction in which an insert in the water trap can be lifted with the aid of the closure valve. The insert is provided at its bottom with a water trap function. The actual water trap, however, is fixedly connected to the drain pipe and cannot therefore be lifted. It is not therefore possible to clean the water trap by lifting the insert.

DE-21 50 158 teaches a water trap, or plumbing trap, which although it can be lifted requires the attachment of a separate lifting device to this end.

The object of the present invention is to provide a water trap which can be removed in its entirety for cleaning purposes, and which is constructed to enable the seal to be removed with a simple lifting movement without the need of a separate lifting device to this end.

This object has been achieved in accordance with the invention, with a water trap of the kind defined in the preamble of Claim 1 and having the particular features set forth in the characterizing clause of said Claim.

SUMMARY OF THE INVENTION

To simplify the fitting, securing and cleaning of a washbasin water trap without the construction impeding the throughflow of water, a washbasin valve with an integrated water trap has been configured as a push-in unit which can be positioned in and fastened to the bottom of a washbasin, or sink, wherewith a waste-water drainage system can be connected directly to the washbasin. The washbasin valve is fitted by inserting the valve into a hole in the bottom of the basin and fixing the valve in position, whereafter the valve is connected directly to a drain pipe. In cleaning the water trap, the trap is pulled-up out of the valve seated in the washbasin, without water being spilled unnecessarily onto the floor beneath the basin or sink. The valve may be provided with a strainer or like device.

DESCRIPTION OF AN EXEMPLIFYING EMBODIMENT

Figure 1C:
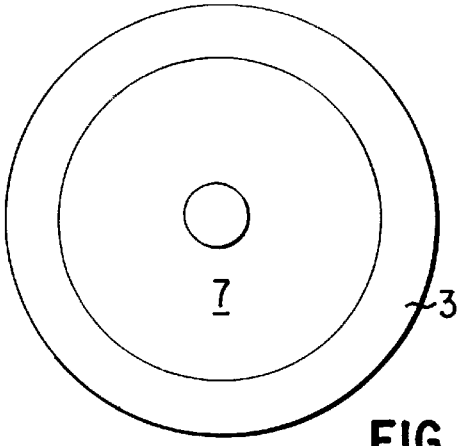
FIG. 1C is a top view of the valve construction of FIG. 1A.
Figure 1B:
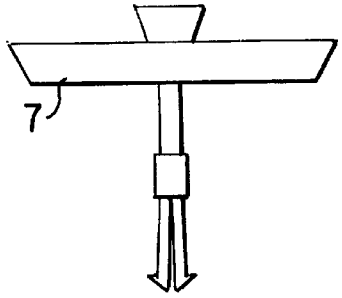
FIG. 1B is a side view of a valve body of the valve construction in FIG. 1A.
Figure 1A:
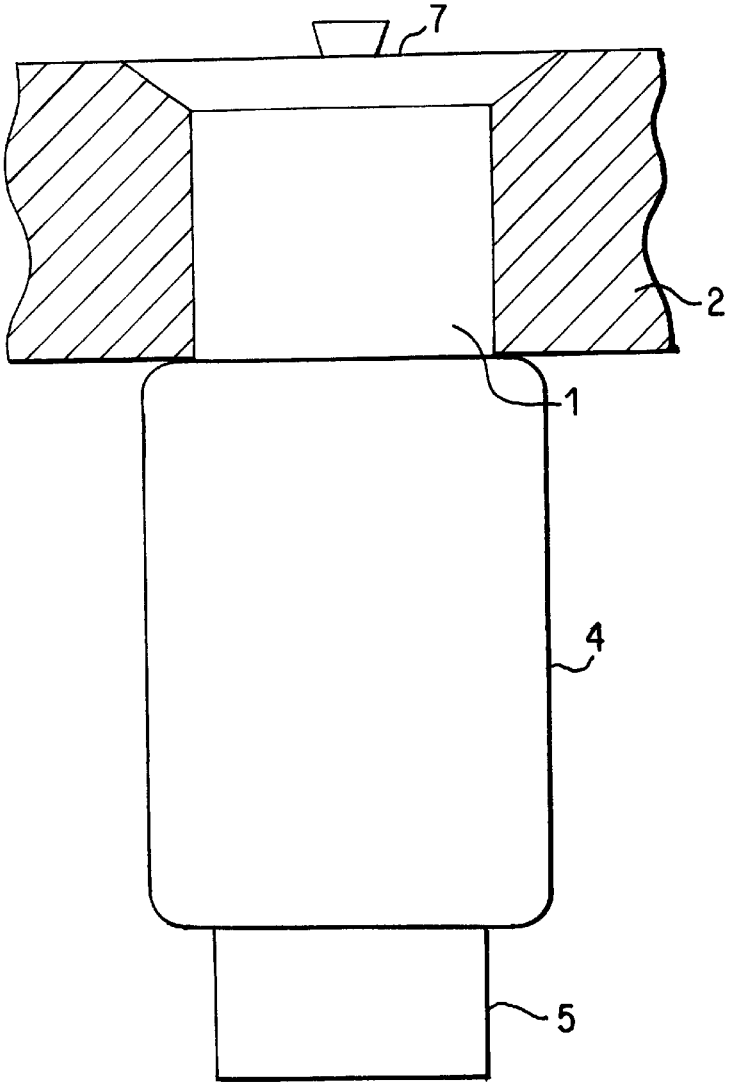
FIG. 1A is a schematic side view of a washbasin valve construction according to the invention fitted to a washbasin.
Figure 2:
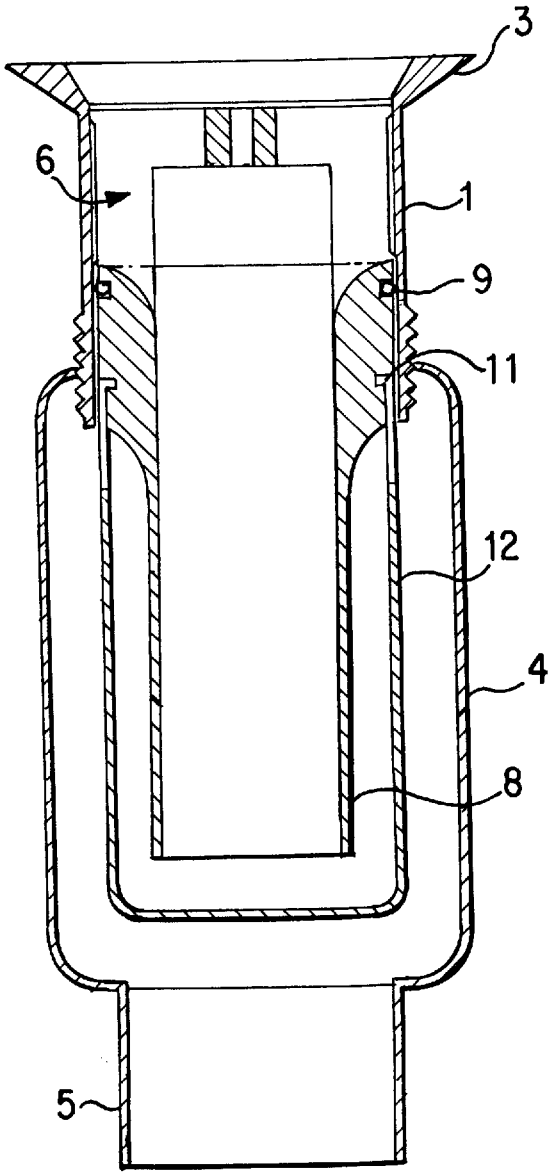
FIG. 2 is a cross-sectional view of the inventive valve.
Figure 3:
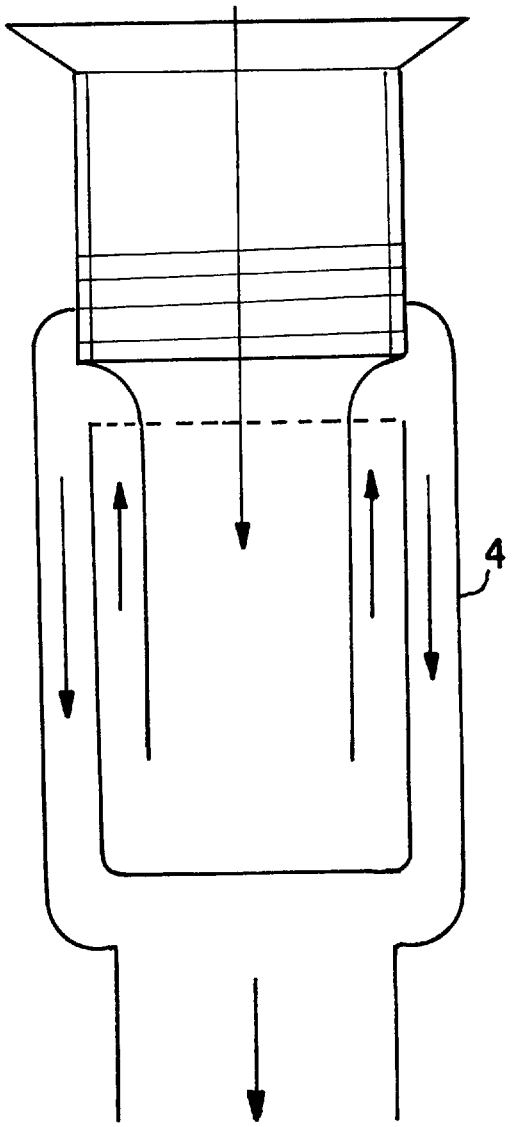
FIG. 3 illustrates the flow of liquid in the valve.
Figure 5B:
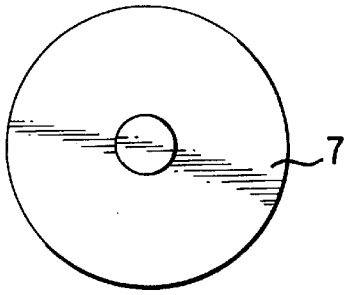
FIG. 5B is a top view of the valve body shown in FIG. 5A.
Figure 6B:
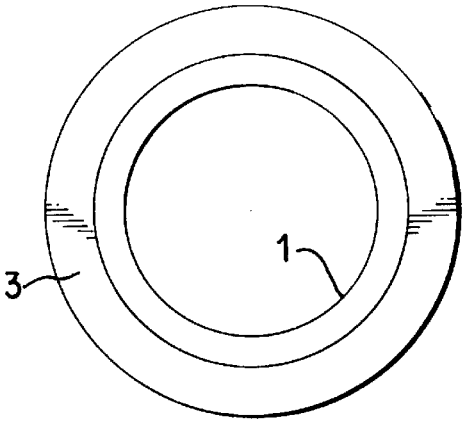
FIG. 6B is a top view of the tubular part shown in FIG. 6A.
Figure 5A:
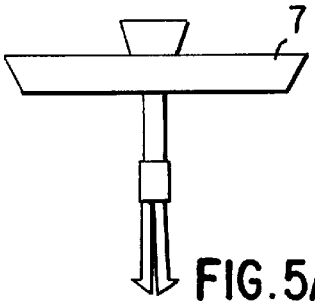
FIG. 5A illustrates the valve body according to the invention.
Figure 6A:
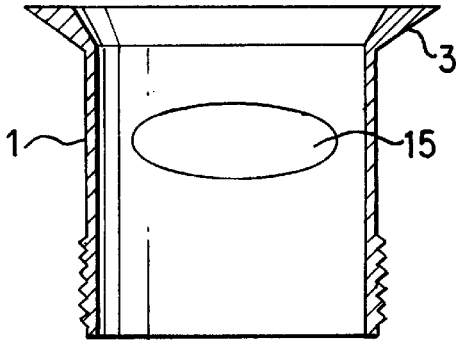
FIG. 6A illustrates the tubular part in FIG. 2.
Figure 4:
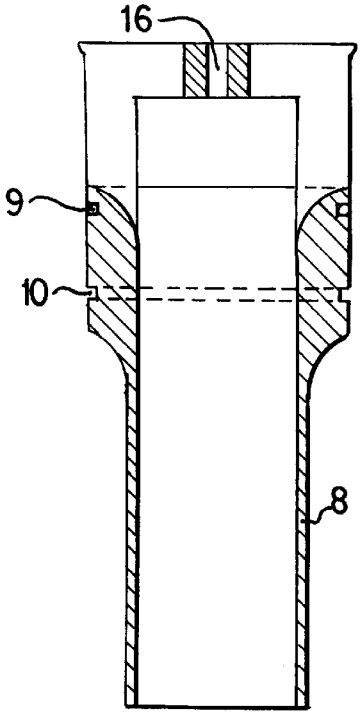
FIG. 4 illustrates the construction which supports the valve body and a cup-shaped part in the valve shown in FIG. 2.
Figure 7:
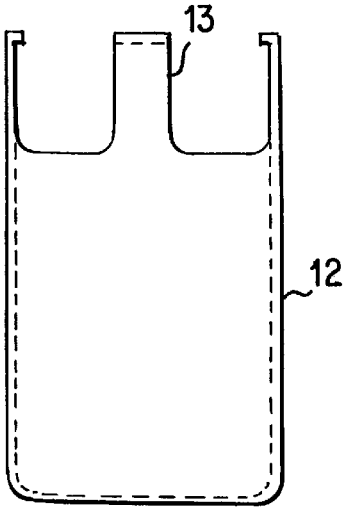
FIG. 7 illustrates the cup-shaped part in FIG. 2.

The Figures illustrate a conceivable construction of an inventive washbasin valve. The valve includes a tubular part 1 which can be pushed into and secured in a hole in the bottom of a washbasin or sink 2. There is provided at the top of the tubular part a flange 3 or the like for abutment with a bevelled edge around the hole in the bottom of the basin. The bottom of the tubular part 1 can be fitted into a pipe 4, which in turn can be connected to either a vertically or horizontally extending drain pipe 5.

A water trap construction 6 is inserted into and fixed in the tubular part 1. Mounted in the top of the water trap construction 6 is a valve body 7 which moves in a guide hole 16, such as to enable the valve body to be brought into an open and a closed position. The lower part of the construction has a tapering tubular form which merges with a straight-cylindrical tube 8. Provided on the outer cylindrical surface of the water trap construction 6 are two grooves 9, 10, the upper groove 9 accommodating a suitable sealing element and the lower groove 10 being intended to receive shoulders 11 on a cup-shaped part 12, which forms the outer limitation of the water trap. The cup-shaped part 12 connects partially or fully with the round-section tubular part of the construction 6 and contains the liquid volume that constitutes the actual water trap. The outer dimension of the cup-shaped part coincides with the outer dimension of said construction, so that the cup-shaped part together with the construction can be fitted into, secured, and withdrawn from the tubular part. The shoulders 11 on the cup-shaped part are in forced engagement with the groove 10 on the construction when fitting, securing and removing the water trap construction with the cup-shaped part, said shoulders being located in the tubular part, i.e. any outward movement of the shoulders is restricted by the inner cylindrical surface of the tubular part.

In emptying the washbasin, water flows past the valve body through, for instance, a strainer provided in the upper end of the tubular part, and down into the straight tube 8 of circular cross-section and into the cup-shaped part 12, therewith filling said part. The water flow turns at the bottom end of the tube and moves up into a space between the outer surface of the tube 8 and the wall of the cup-shaped part 12, until the level of water reaches an upper opening between a connection element 13 located between the cup-shaped part and its shoulders, wherein the water runs over an edge and down, for instance, into a connecting sleeve 4 connected to a drain pipe 5. When the water trap is used in a washbasin or sink, the space in the inner tubular part will be partially filled with water. The external connecting sleeve may be press-fitted onto the washbasin valve in the washbasin, optionally with an O-ring.

The strainer or a connecting part uppermost in the valve may be provided with a rotatable disk which includes one or more openings which coincide with one or more openings in an associated valve part in given positions of rotation. When the washbasin includes a safety drain, it is necessary to provide the tubular part with an opening 15 which registers with the drain opening in the basin.

The water trap construction may be comprised of PVC plastic, which is a suitable material for handling cold and hot water and provides a shape-stable construction. The valve can easily be dismantled for cleaning purposes, wherein the water trap construction with cup-shaped member is lifted-out from the tubular part 1, for instance together with the valve body, while leaving the tubular part 1 connected to the water drainage system.

I claim:

1. A washbasin valve having a valve body and an integrated water trap for simple fitting and cleaning, characterized in that a tubular part is arranged for insertion into a hole in the bottom of a washbasin; in that the water trap includes a structure having an outer wall surface including one or more grooves, said structure coacts with the tubular part; in that the water trap also includes a cup-shaped part having shoulders, said cup-shaped part partially surrounds the structure and is arranged to be fastened thereto, wherein with the cup-shaped part connected to the structure and inserted into the tubular part the cup-shaped part is fixedly connected to said structure and provides a water trap when liquid flows therethrough, and wherein the cup-shaped part can be removed from the tubular part and loosened from the structure to enable cleaning of said structure and said cup-shaped part, characterized in that the structure includes a centrally positioned guide hole for guiding the valve body which can be brought to at least two positions, a closed position in which flow through the washbasin valve is shut off and an open position in which flow through the washbasin valve is allowed, and which can be used to remove the structure with the cup-shaped part out of the tubular part solely by one lifting movement.

2. A valve according to claim 1, characterized in that the shoulders of said cup-shaped part are intended to forcibly engage one of said grooves.

3. A valve according to claim 1, characterized in that the bottom edge of the tubular part is embraced by a tube, wherein the valve can be connected by said tube to a drain pipe after having fitted the valve to a washbasin, and wherein the tube need not be loosened or removed when cleaning the water trap.

* * * * *